US005979876A

United States Patent [19]

Cardona

[11] Patent Number: 5,979,876

[45] Date of Patent: Nov. 9, 1999

[54] JACK BAR QUICK RELEASE

[75] Inventor: Edgardo Cardona, Atchison, Kans.

[73] Assignee: Kinedyne Corporation, North Branch, N.J.

[21] Appl. No.: 09/197,547

[22] Filed: Nov. 23, 1998

[51] Int. Cl.[6] ..... B66F 1/04

[52] U.S. Cl. ..... 254/108

[58] Field of Search ..... 254/106, 107, 254/108, 109, 110, 111

[56] References Cited

U.S. PATENT DOCUMENTS 1,175,211 3/1916 Willour .
1,802,067 4/1931 Reif .
1,974,491 9/1934 Hawley .
2,501,603 3/1950 Howard .
3,007,676 11/1961 Javorik ..... 254/108
3,588,046 6/1971 Weaver et al. ..... 254/110
3,737,147 6/1973 Morgan et al. .

*Primary Examiner*—Timothy V. Eley
*Assistant Examiner*—Benjamin M. Halpern
*Attorney, Agent, or Firm*—Young & Basile, P.C.

[57] ABSTRACT

In a dunnage jack bar assembly of the longitudinal ratchet type wherein the length of the jack bar assembly is adjusted by a carriage slidably mounted upon the jack bar having locking and power pawls operated by an oscillating operating lever wherein the pawls engage the teeth of the jack bar to translate the carriage thereon. A quick release lever mounted upon the operating lever selectively lifts the locking pawl from the jack bar teeth to permit a rapid translation of the carriage on the jack bar in either direction.

7 Claims, 1 Drawing Sheet

JACK BAR QUICK RELEASE

BACKGROUND OF THE INVENTION

1. Field of the Invention

The invention pertains to longitudinally adjustable dunnage jack bar assemblies having a carriage slidably mounted on a jack bar longitudinally adjustable by an operating lever having power and lock pawls mounted thereon.

2. Description of the Related Art

Jacks and hoisting devices utilizing an elongated rigid toothed tube or bar having a movable carriage thereon wherein the carriage includes a pivoted operating lever controlling the movement of power and lock pawls have been known for many years. As illustrated in U.S. Pat. Nos. 1,175,211; 1,802,067; 1,974,491; 2,501,603 and 3,737,147, such devices have commonly been employed in the jack art, and bumper jacks using a toothed column were popularly employed as an automobile jack in the 1970's.

The principles existing with bumper jacks and the like have been utilized in the freight dunnage art wherein toothed jack bars extend between the sides of a van freight storage space having a carriage mounted thereon to which a van engaging abutment is mounted. By oscillating the carriage operating lever, the power and locking pawls mounted upon the operating lever translate the carriage on the jack bar to selectively adjust the length of the jack bar assembly permitting the jack bar to be tightly held in place by the van walls as the carriage is moved to lengthen the overall length of the jack bar assembly. As with automobile jacks, a dunnage jack bar assembly includes a release lever which permits the sequence of operation of the power and lock pawls to be reversed so that the length of the assembly can be retracted to permit the jack bar to be removed from its operative relationship to the van walls. While such operation of the reversing lever permits the carriage to be incrementally translated on the jack bar in a "retracting" direction, the spring biasing the locking lever toward the jack bar remains effective and prevents a rapid movement of the carriage on the jack bar in the retracting direction. A rapid translation of the carriage on the jack bar is only possible in extension direction.

In many instances, it is desirable to rapidly slide the carriage on the jack bar in either direction in order to permit a rapid initial jack bar assembly length adjustment prior to incrementally lengthening the jack bar assembly by oscillating the operating lever, but previously, such a release of the carriage as to permit rapid bi-directional movement on the jack bar has not been available.

OBJECTS OF THE INVENTION

It is an object of the invention to provide a toothed dunnage jack bar having a carriage movably mounted thereon wherein the carriage includes both power and lock pawls biased toward the jack bar by spring means, and wherein a quick release actuator permits the lock lever pawl to be lifted against its biasing spring to permit rapid adjustment of the carriage.

It is another object of the invention to provide a toothed dunnage jack bar having a carriage operated by a pivotal operating lever wherein the lock pawl carried by the carriage may be held away from the jack bar teeth against the biasing force produced by a spring associated with the lock pawl.

Yet another object of the invention is to provide a toothed dunnage jack bar assembly which includes a carriage slidably mounted upon an elongated jack bar wherein a quick release actuator of the lever type is mounted upon the carriage operating lever and is readily accessible by the operator to permit bi-directional movement of the carriage on the jack bar in a quick release operation.

SUMMARY OF THE INVENTION

A conventional toothed dunnage jack bar assembly includes a carriage slidably mounted upon the jack bar on which an operating lever is pivotally mounted. The operating lever includes an operating pawl spring biased toward the jack bar teeth and pivotally mounted on the operating lever so as to engage the jack bar teeth as the lever is moved in a forward or operating direction. A lock pawl is also pivotally mounted on the carriage, usually upon the operating lever pivot, having an outer end for engaging the jack bar teeth, and a spring is employed to bias the lock pawl toward the jack bar teeth.

A quick release lever is also pivotally mounted on the operating lever having an end adjacent a hand grip defined on the operating lever for easy access by the operator. The other end of the quick release lever engages the lock pawl spring whereby actuation of the quick release lever from an inoperative position to an operative position lifts the lock pawl against its biasing force to remove the lock pawl from the jack bar teeth. Upon the locking lever being lifted from the jack bar teeth, the carriage can be quickly moved in either direction on the jack bar providing a quick adjustment of the length of the jack bar which aids in locating the jack bar within the van as desired, and permitting a "rough" adjustment of the jack bar length.

In the practice of the invention, a single leaf spring is used to bias both the power pawl and the lock pawl toward the teeth of the jack bar. The configuration of the pawl spring includes a substantially flat land portion adjacent the spring end anchored to the lock pawl and the quick release lever engages this spring flat when the quick release lever is pivoted to its operative position. In this manner, the locking pawl spring is rendered inoperative and is actually used to "lift" the lock pawl from the jack bar teeth.

The quick release lever may be readily mounted upon the jack bar operating lever pivoted to the carriage and the practice of the invention adds very little cost to the jack bar.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
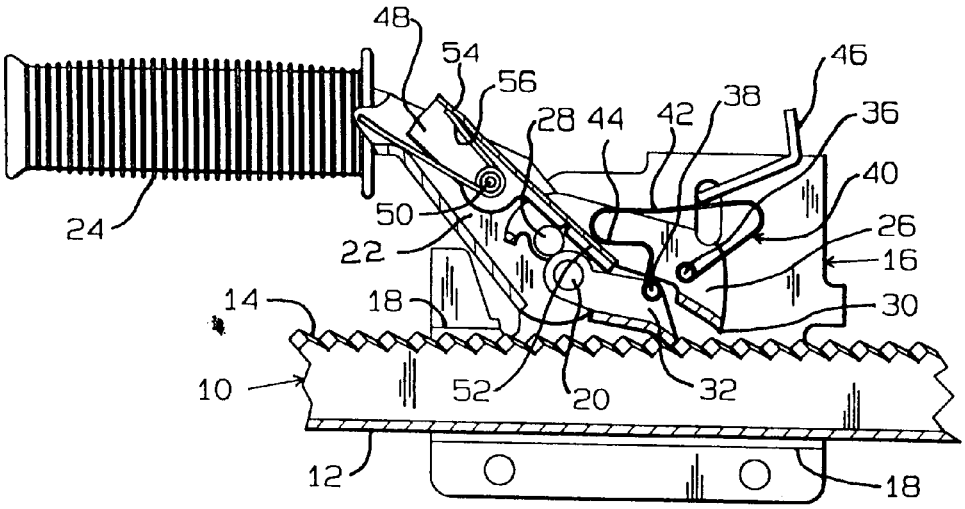
FIG. 1 is an elevational view, partially sectioned, illustrating a jack bar and carriage assembly in accord with the invention illustrating the quick release actuator in its inoperative position and the lock pawl engaging the jack bar teeth.

With reference to FIG. 1, an elongated jack bar assembly is illustrated at 10, and the jack bar itself is usually of a box construction having a straight or lower edge 12 and an upper edge upon which teeth 14 are formed. The teeth 14 may be formed by a rolling operation. The purpose of the jack bar assembly 10 is to restrain the movement of freight within a van or box car and one end of the jack bar assembly 10 will include a fitting, not shown, for reception into a wall mounted track, or a friction pad is mounted upon the end of the jack bar for engaging the van wall.

The other end of the jack bar assembly 10 also includes a friction pad or track receiving fitting, not shown, which is mounted upon the carriage 16 extending to the left of the carriage, FIG. 1. The carriage 16 is longitudinally translatable upon the jack bar, and is usually formed of a sheet stamping or a pair of stampings riveted together wherein a box opening is formed in the carriage about the jack bar defining track surfaces 18 guiding the carriage movement upon the jack bar.

A pivot 20 is mounted upon the carriage 16 pivotally supporting the operating lever 22 which includes a handle 24 which may be gripped by the operator wherein the lever 22 may be oscillated about the pivot 20.

A power pawl 26 is pivotally mounted upon the operating lever 22 by pivot 28 which, as will be appreciated from FIG. 1, is spaced from the axis of pivot 20. The pawl 26 includes a point 30 adapted to selectively engage the teeth 14 of the jack bar.

A smaller lock pawl 32 is pivotally mounted upon pivot 20 and includes a point 34 adapted to engage the jack bar teeth 14. A spring anchor 36 is defined upon power pawl 26, while the spring anchor 38 is defined on the lock pawl 32.

The pawls 26 and 32 are resiliently biased toward the jack bar teeth 14 by a shaped leaf spring 40. One end of the leaf spring 40 is attached to the spring anchor 36, while the other end of the leaf spring is attached to spring anchor 38, and the spring includes a bridge section 42, and a flat land 44 defined close to the spring anchor 38 for cooperation with the quick release actuator, as later described.

A reversing release lever 46 is mounted upon the carriage 16 and engages the spring bridge section 42 wherein the spring action can be modified by the reversing lever 46 when it is desired to retract the carriage 16 on the jack bar 10 to shorten the length of the jack bar assembly. When the reversing lever 46 is actuated, the oscillation of the operating lever 22 will permit the carriage to be moved in the direction opposite, or to the right, with respect to the carriage extension direction of movement.

A quick release lever 48 which may be of a U cross sectional configuration, is pivotally mounted upon the pivot 50 mounted on the operating lever 22. The quick release lever 48 includes a lower portion 52 which extends under the spring lift land portion 44, and an upper portion 54 located on the opposite side of the pivot 50 which is accessible to the operator grasping the handle 24. For instance, the operator's thumb can readily be placed upon the upper portion 54 for depressing the same. A torsion spring 56 wound about pivot 50 biases the quick release lever 48 in a clockwise direction as viewed in the drawings.

In operation, the components will normally be as shown in FIG. 1. The spring 56 will have pivoted the quick release lever 48 to a maximum extent in the clockwise direction, and the curved portion of the leaf spring 40 adjacent the land 44 will be engaging the release portion 52 whereby the configuration of the spring 40 biases the lock pawl 32 toward the jack bar teeth 14. The spring release lever 46 will be in the position to bias the power pawl 26 toward the jack bar teeth 14 and oscillation of the operating lever 22 by force applied to the handle 24 will incrementally displace the carriage 16 to the left on the jack bar as viewed in the drawings extending the length of the jack bar assembly forcing the assembly ends against the van sides. In this manner, the jack bar assembly will operate in a manner similar to that shown in the previously cited prior art during a lifting or power cycle.

Figure 2:
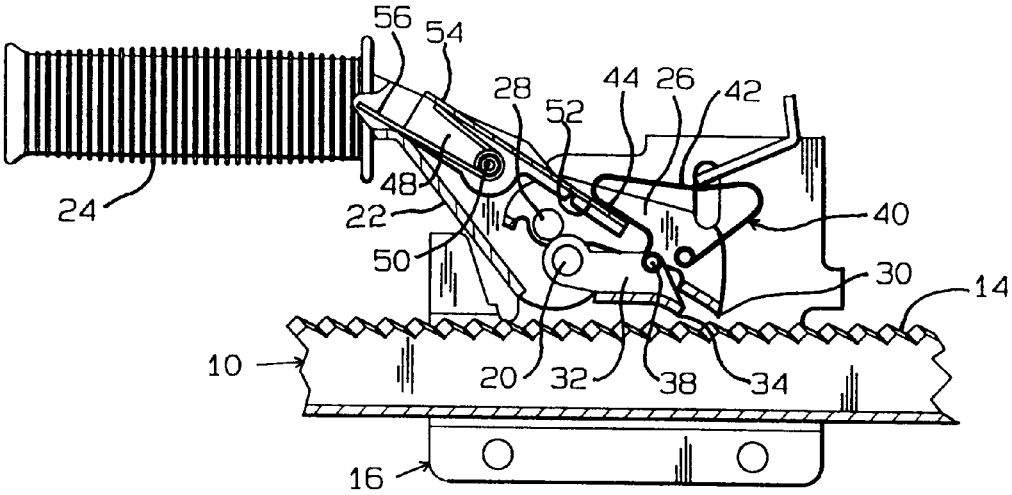
FIG. 2 is an elevational sectional view similar to FIG. 1 illustrating the quick release lever actuator in its operative position engaging the spring of the lock pawl to lift the lock pawl from the jack bar teeth and permit quick adjustment of the carriage thereon.

When it is desired to quickly shift the carriage 16 on the jack bar in either direction, the operator depresses the quick release lever upper portion 54 which causes the lower portion 52 to engage the spring land 44, FIG. 2, and raise the spring adjacent the lock pawl anchor 38. This action lifts the lock pawl 32 from the teeth 14 permitting the carriage 16 to be moved in either direction on the jack bar 10, assuming the operating lever 22 is in the position shown wherein the power pawl 26 will also be out of engagement with the teeth 14.

Accordingly, the use of the quick release lever 48 permits both pawls 26 and 32 to be lifted from the jack bar teeth 14 permitting the carriage 16 to be longitudinally adjusted as desired on the jack bar, and this rapid adjustment of the carriage facilitates the positioning of the jack bar assembly on the van wall sides.

It is appreciated that various modifications to the inventive concepts may be apparent to those skilled in the art without departing from the spirit and scope of the invention.

I claim:

1. A jack bar assembly capable of incrementally increasing its length wherein an elongated toothed jack bar includes a carriage freely longitudinally movable thereon, a pivoted operating lever mounted on the carriage and pivoted power and lock pawls mounted on the operating lever biased toward the jack bar by power pawl and lock pawl spring means, respectively, the improvement comprising, a quick release actuator movably mounted on and relative to the operating lever movable between quick release operative and inoperative positions, said quick release actuator operative position disengaging the lock pawl from the teeth of the jack bar to permit quick adjustment of the carriage on the jack bar in either longitudinal direction.

2. In a jack bar assembly as in claim 1, a quick release pivot mounted on said operating lever, said quick release actuator comprising a release lever mounted upon said quick release pivot.

3. In a jack bar assembly as in claim 1, said quick release actuator being operatively connected to the lock pawl spring means wherein said operative position of said quick release actuator renders said lock pawl spring means inoperative with respect to biasing the lock pawl toward the jack bar.

4. In a jack bar assembly as in claim 3, spring anchors defined on said power and lock pawls, the power pawl and lock pawl spring means comprising a single shaped leaf spring having first and second ends anchored to the power pawl and lock pawl anchors, respectively.

5. In a jack bar assembly as in claim 4, said quick release actuator engaging said leaf spring adjacent said second end lifting the lock pawl from the jack bar when in the operative position.

6. In a jack bar assembly as in claim 5, said leaf spring including a substantially flat land adjacent said leaf spring second end, said quick release actuator engaging said leaf spring land.

7. In a jack bar assembly as in claim 6, said quick release actuator comprising a lever pivotally mounted on the operating lever engaging said leaf spring land.

* * * * *

US005979876C1

(12) EX PARTE REEXAMINATION CERTIFICATE (8468th)

United States Patent
Cardona

(10) Number: US 5,979,876 C1
(45) Certificate Issued: Aug. 16, 2011

(54) JACK BAR QUICK RELEASE

(75) Inventor: Edgardo Cardona, Atchison, KS (US)

(73) Assignee: Kinedyne Corporation, North Branch, NJ (US)

Reexamination Request:
No. 90/010,412, Mar. 16, 2009

Reexamination Certificate for:

| | |
|---|---|
| Patent No.: | **5,979,876** |
| Issued: | **Nov. 9, 1999** |
| Appl. No.: | **09/197,547** |
| Filed: | **Nov. 23, 1998** |

(51) Int. Cl.

| | |
|---|---|
| ***B66F 1/00*** | (2006.01) |
| ***B66F 1/06*** | (2006.01) |
| ***B66F 1/04*** | (2006.01) |

(52) U.S. Cl. ..... 254/108
(58) Field of Classification Search ..... 254/106–111
See application file for complete search history.

(56) References Cited

U.S. PATENT DOCUMENTS

| | | | | | |
|---|---|---|---|---|---|
| 5,094,576 | A | * | 3/1992 | Fredelius | 410/151 |
| 5,833,414 | A | * | 11/1998 | Feldman et al. | 410/151 |
| 5,890,856 | A | * | 4/1999 | Huang | 410/151 |
| 5,947,666 | A | * | 9/1999 | Huang | 410/151 |

OTHER PUBLICATIONS

"lever". (2010). In Merriam–Webster Online Dictionary. Retrieved Mar. 1, 2010, then <http://www.merriam–webster.com/dictionary/lever>.*

* cited by examiner

*Primary Examiner*—Sara Clarke

(57) ABSTRACT

In a dunnage jack bar assembly of the longitudinal ratchet type wherein the length of the jack bar assembly is adjusted by a carriage slidably mounted upon the jack bar having locking and power pawls operated by an oscillating operating lever wherein the pawls engage the teeth of the jack bar to translate the carriage thereon. A quick release lever mounted upon the operating lever selectively lifts the locking pawl from the jack bar teeth to permit a rapid translation of the carriage on the jack bar in either direction.

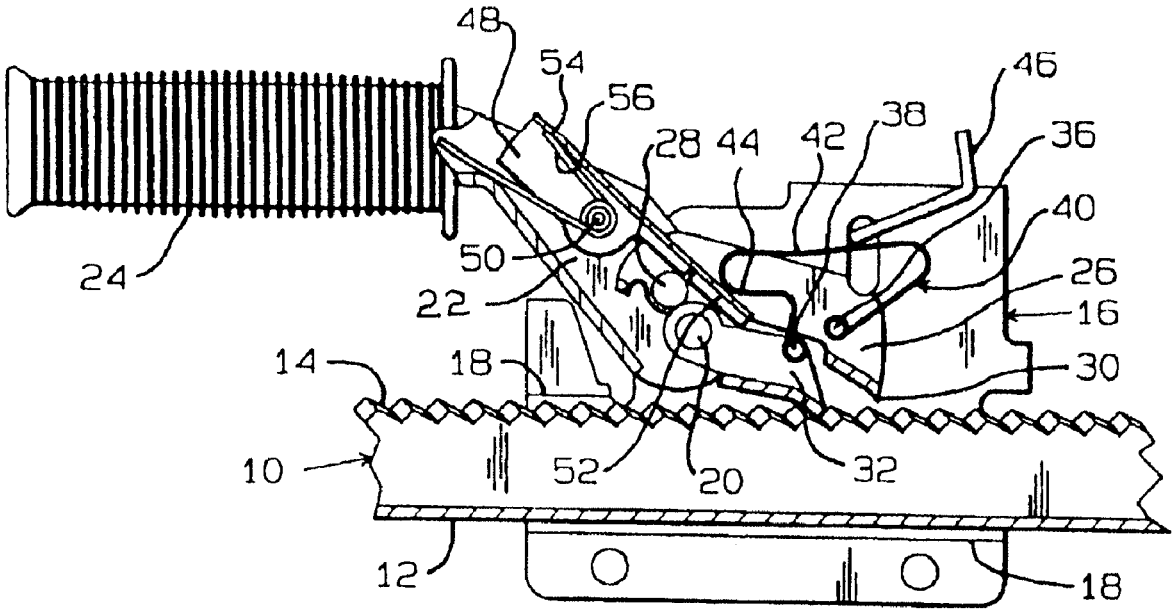

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *